United States Patent [19]

Schwarze et al.

[11] Patent Number: 4,736,467

[45] Date of Patent: Apr. 12, 1988

[54] OPERATING ROOM CLOTHING SYSTEM

[75] Inventors: Charles P. Schwarze, Fairfield, Conn.; Edmund S. Rumowicz, Somerset; Robert M. Colletti, East Brunswick, both of N.J.

[73] Assignee: Burlington Industries, Inc., Greensboro, N.C.

[21] Appl. No.: 946,015

[22] Filed: Dec. 24, 1986

[51] Int. Cl.[4] ..... A41D 13/12

[52] U.S. Cl. ..... 2/114; 2/82; 2/227; 2/237; 128/132 D; 428/246; 428/907

[58] Field of Search ..... 2/DIG. 7, 51, 114, 227, 2/228; 128/132 D; 604/360, 377; 428/246, 907; 2/82

[56] References Cited

U.S. PATENT DOCUMENTS

| | | | |
|---|---|---|---|
| 3,072,534 | 1/1963 | Roth et al. | 167/84 |
| 3,349,285 | 10/1967 | Belkin | 2/114 X |
| 3,521,624 | 7/1970 | Gander et al. | 128/132 D |
| 3,691,570 | 9/1972 | Gaines et al. | 428/907 X |
| 3,868,728 | 3/1975 | Krzewinski | 2/114 |
| 4,196,245 | 4/1980 | Kitson et al. | 2/DIG. 7 X |
| 4,214,320 | 7/1980 | Belkin | 2/114 |
| 4,372,309 | 2/1983 | Fowler | 604/360 X |
| 4,411,928 | 10/1983 | Baldwin | 427/2 |
| 4,414,268 | 11/1983 | Baldwin | 428/289 |
| 4,425,372 | 1/1984 | Baldwin | 427/2 |
| 4,433,026 | 2/1984 | Molde | 428/252 |
| 4,467,013 | 8/1984 | Baldwin | 428/289 |
| 4,499,139 | 2/1985 | Schortmann | 428/245 |
| 4,504,978 | 3/1985 | Gregory et al. | 2/114 X |
| 4,586,196 | 5/1986 | White | 2/114 |

FOREIGN PATENT DOCUMENTS 0124869 5/1984 European Pat. Off. .

OTHER PUBLICATIONS

"Microbial Penetration of Surgical Gown Materials", J. T. Schwartz et al., Dept. of Pathology, Section of Microbiology and Dept. of Surgery Wilmington Medical Center, Wilmington.

"Surgical Barrier Materials: Product Promotion Vs. Control Evidence Laufman, *Operating Room Environment*", May 1982, Bulletin.

"Design of Operating-Room Dress for Surgeons", Blowers et al., *The Lancet*, Oct. 2, 1985.

"Clothing Design for Operating-Room Personnel", Mitchell et al., *The Lancet*, Nov. 9, 1974.

"The Effect of Clothing on the Dissemination of Bacteria in Operating Theatres", *Brit. J. Surg.*, 1972, vol. 59, No. 11, Nov., by C. M. Doig.

"The Surgeon's Garb", Ritter et al., *Clinical Orthopaedics and Related Research*, No. 153, Nov.-Dec. 1980.

*Primary Examiner*—Wm. Carter Reynolds

*Attorney, Agent, or Firm*—Nixon & Vanderhye

[57] ABSTRACT

A system of operating room garments including two-component scrub pants with an elastic waist band and elastic bands in the mid-thigh area to define a containment zone between the two and knit cuffs at the ankle area, to be worn under a tabard for maximum protection against bacterial transmission is required and, over both, a surgical gown is worn with barrier panel sleeves and in the chest area extending from the neck to the mid-thigh area. The barrier panel composed of a bacteriostatically-treated polyester/cotton fabric sandwiched between a pair of light-weight, water repellent tightly woven, fine denier, breathable polyester fabrics, the composite being stitched together. The system provides the choice of garment selection depending upon the surgical procedure involved.

39 Claims, 3 Drawing Sheets

OPERATING ROOM CLOTHING SYSTEM

BACKGROUND OF THE INVENTION

This invention relates to clothing worn by a surgeon or other medical practitioner in an operating room or other surgical environment. Specifically, the invention includes a multi-component series of specially constructed garments including scrub pants, a tunic and, over both, a surgical gown. Each of the three components is constructed of specific materials that are selected based upon the surgical procedure involved, primarily the time required for the procedure, as well as other medical considerations.

Reusable surgical gowns and drapes have traditionally been made of cotton or a cotton/polyester blend having a high thread count, such as 140-thread count per square inch for cotton muslin up to 240 to 280 threads per square inch for tighter woven pima cotton. Higher thread counts afford smaller interstices between the threads. These reusable woven materials are washed, sterilized, usually by autoclaving in steam, and wrapped in a sterile package to retain sterility until use. After use, the reusable gown is recycled by again washing, autoclaving, sterile wrapping, etc. Multiple use garments for medical applications require careful washing and sterilization because of the concern for potential contamination from one procedure and event to the next. Thus, single use disposable garments, particularly for medical applications, have been well received.

Prior proposals for surgical gowns and drapes include a three-component laminate as described in U.S. Pat. No. 4,433,026 composed of a knit cotton layer and a polyester continuous filament outer layer with an expanded yet breathable PTFE film interposed between the two. The expanded PTFE film laminated between the two fibrous layers is said to impart breathability to the composite, but nothing is mentioned about the effect, if any, upon bacteria or other pathogens.

U.S. Pat. No. 4,499,139 describes a one piece non-woven bacterial barrier material in which a small cell foam is placed within the non-woven substrate to define a bacterial barrier. Absorbent microbiocidal fabrics are described in U.S. Pat. Nos. 4,408,996; 4,414,268; 4,395,454 and 4,425,327. These patents describe surgical drapes that have an absorbent, highly-wettable, bioactive surface made of a non-cellulosic substrate with a non-leachable, bioactive compound fixed to the substrate. Non-woven fabrics treated to repel water, saline solution, body fluids and solvents are described in U.S. Pat. Nos. 4,411,928 and 4,467,013. The non-woven fabric is provided with a bioactive finish, and the fabrics so-produced are described as useful for the construction of surgeon's gowns, medical drapes, isolation gowns, instrument wraps and the like.

To our knowledge, the art does not describe a system of multiple garments to be worn in the operating room or area of other surgical procedure that will protect the patient from the aerial dispersion of pathogens from the personnel in the operating room, yet remain comfortable for the medical practitioner to wear, especially for extended periods of time for those procedures during which the garments are worn for several hours. At least one garment of our invention is provided with bacteriostatic barrier panels strategically placed at those portions of the garment most likely to permit bacterial release, yet the barrier panels remains durable, comfortable and effective to resist wet bacterial strike through.

Preferably, all of the garments are provided with a bacteriostatic finish that is substantive on the fabric and confers antibacterial properties to each of the garments. The garments are constructed in such a way as to contain pathogens originating from the wearer in those areas of the garment most likely to cause concern as well as to prevent, to the extent possible, airborne bacteria from escaping below the garments.

BRIEF DESCRIPTION OF THE INVENTION

Disclosed is a system of operating room garments including two-component scrub pants with, preferably, an elastic waist band and a pair of elastic bands in the mid-thigh area to define a containment zone between the two, and knit cuffs at the ankle area. The scrub pants are worn under a tabard or tunic which may be worn for more stringent operating conditions where maximum protection against bacterial transmission is required, and over both, a surgical gown is worn optionally with barrier panel sleeves, at least up to the elbow, and in the chest area extending from the neck to the mid-thigh area. The surgical gown extends to the floor length or nearly floor length.

Also disclosed is a barrier panel composed of a bacteriostatically-treated polyester/cotton fabric sandwiched between a pair of tightly woven, fine denier, breathable polyester fabrics that are virtually impenetrable to bacteria, the composite being stitched together. The system provides a selection of garments depending upon the surgical procedure involved, and affords economy in that the less rigorous procedures will not require all three garments, in combination, and/or may permit the use of garments constructed of less costly materials, for instance without the various barrier panels, again depending upon the surgical procedure.

Specific components of this system include scrub pants, an undergown tabard, a full length surgical gown and a barrier panel composite that may be placed at strategic positions in constructing the scrub pants, tabard or the surgical gown.

DETAILED DESCRIPTION OF THE INVENTION

Post-operative wound infection can be attributed to several sources. Among the list of possible routes of bacterial transmission is the surgeon's gown. Worn over conventional "scrub" attire, the gown must be constructed so that both fabric and design contribute to form an effective bacteria barrier between patient and surgeon. Most reusable gowns are marginal at best when evaluating durable bacterial barrier properties and assuring sterility after previous use(s) is always a concern.

Our invention includes a complete system of operating room clothing designed for various classes of operation and allows selection of only combination of garments based on duration of the surgical procedure, the patient's susceptibility to infection and the planned surgical activity, i.e., situs of the procedure. The longer, more difficult operations which would normally produce a greater probability of developing a post-operative infection require the use of a package of operating room clothing designed to afford maximum protection for the patient. Less severe procedures require fewer items in a package composed of less rigorous and less costly, lesser quality barrier materials.

Each piece of clothing in this complete system is described in detail below.

Surgical Garments: For most procedures, traditional scrub pants or "scrubs" are constructed of antimicrobial-treated fabrics specially treated with an antimicrobial material that inhibits the growth of bacteria and thus reduces the number of bacteria released into the air where airborne transmission of bacteria is of concern in the operating room. The scrub pants are made with stockinette cuffs at the ankles.

Figure 1:
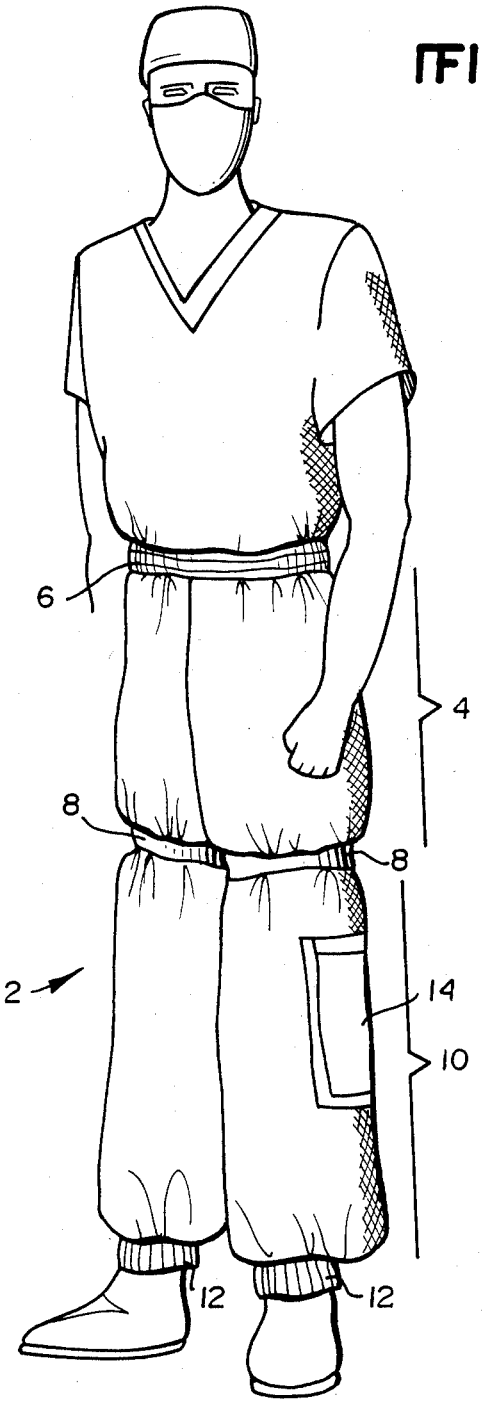
FIG. 1 is a perspective illustration of a surgeon wearing the two-component scrub pants in accordance with the invention.

Two component scrub pants in accordance with the invention are shown in FIG. 1. The perineal area of the body has been identified as disseminating the greater number of pathogens; see Ritter et al, "The Surgeon's Garb", Clinical Orthopaedics 153 p.204–209 (1980). To contain this potentially dangerous flora, scrub pants with a tightly woven, fine denier polyester barrier fabric from elastic waist to elastic band in the mid thigh area are constructed. The remainder of the pant is composed of an antimicrobial treated polyester/cotton blend product.

Figure 4:
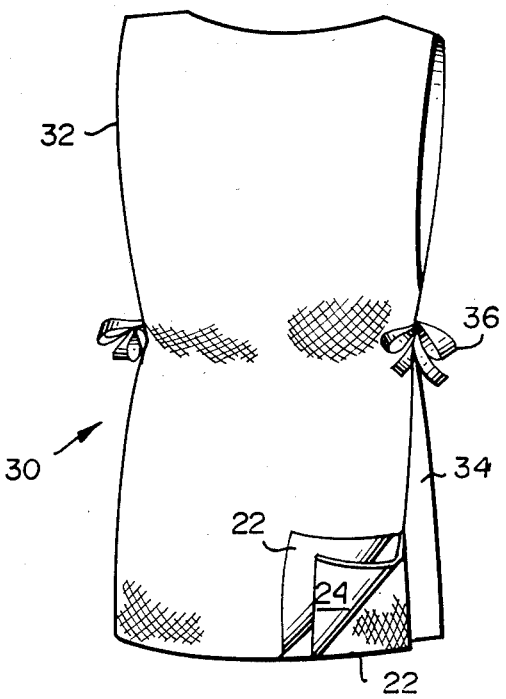
FIG. 4 is a front view of a tabard or tunic the front of which is made of the barrier material of FIG. 2
Figure 5:
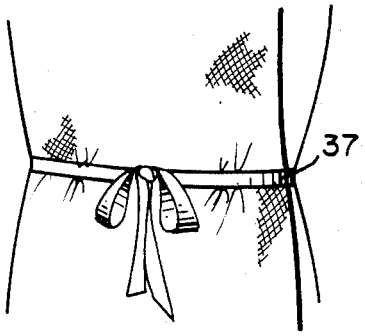
FIG. 5 is a partial perspective view of the waist of the same tunic.
Figure 6:
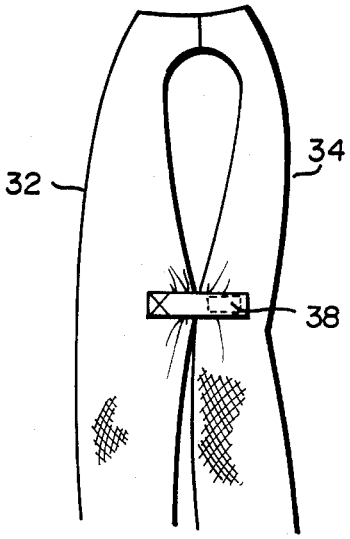
FIG. 6 is a perspective view of the side of another waist closure arrangement for a tunic.

The tabard illustrated in FIGS. 4–6 with side closures is for more severe operating conditions where maximum protection against bacterial transmission is required. This garment is designed to be worn over the scrub outfit (pants plus shirt) and under the surgical gown.

Figure 7:
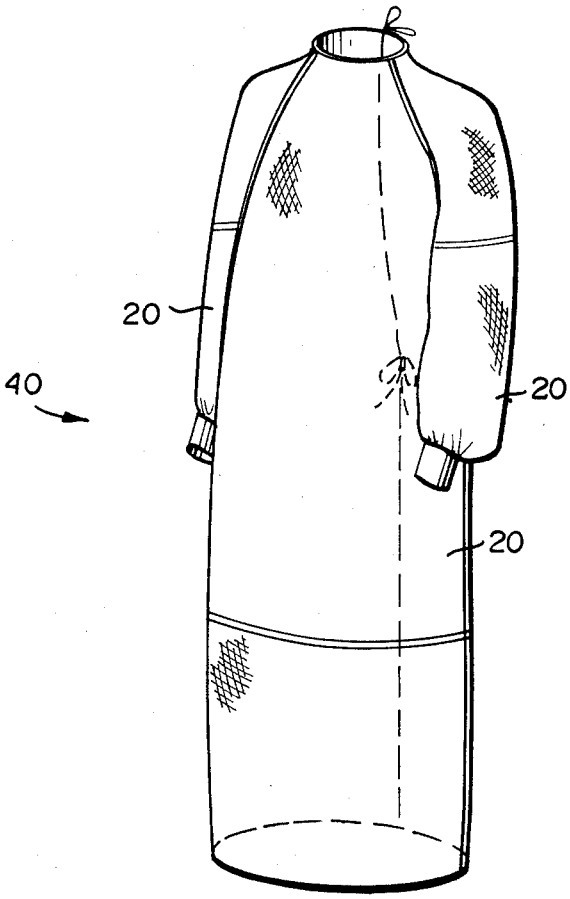
FIG. 7 is a perspective front view of a surgical gown with the sleeve portions and front panel from the neck to below the knee area made of the barrier panel composite of FIG. 2.

Current barrier panels in existing gowns are not as effective as they should be with regard to durability and resistance to wet bacterial strike through. To solve this problem, the barrier panel will be composed of a single ply of light weight fabric treated with a bacteriostatic material preferably woven from an intimate blend of 65% polyester fibers and 35% cotton fibers made from 26/1 yarns. Sandwiching this polyester/cotton fabric are two single layers of light weight, tightly woven polyester. Unlike previous proposals, the three layers are not laminated or glued together; they are stitched around the edges. This composite construction has proven to be an effective bacterial barrier. The barrier panel is used in the surgical gown in the sleeves up beyond the elbow, in the chest area from the neck to the mid thigh area, and from side to side. Antimicrobial treated fabric is used in all other areas of the gown. To improve the gown's efficacy in preventing airborne bacteria from escaping below (conventional gowns are mid-calf length), the gown's length is extended to the shoe-top level as shown in FIG. 7.

The tightly-woven, fine denier fabric suitable for constructing the barrier panel of this invention is highly water resistant (Suter hydrostatic pressure AATC 127-1980 of at least 500 mm, preferably at least about 800 mm) yet highly breathable (moisture vapor transmission ASTM E-96, Method A, of at least 1,000 $gm/m^2/24hr$) as well as windproof (having an air porosity value of less than about 3 cfm according to the Frazier method). One particular fabric useful in constructing garments according to this invention having the required moisture vapor transmission yet low air permeability is made of a high density woven fabric woven from super fine denier, multi-filament, synthetic yarn, usually polyester. Such a fabric is available from Burlington Industries, Inc., under the trademark VERSATECH®. A piece of VERSATECH® fabric, at a magnification of 50 times, is photographed in FIG. 3 revealing the numerous fine denier multi-filament yarns which make up the weave of the fabric. The tightly-woven, fine denier fabric has virtually no intersial space and as such acts as a highly effective barrier to bacteria. Bacteria are said to range in size from about 0.5 microns to up to 5 microns with an average size of about 1.5 microns according to the literature. Bacterial shapes range from round to ovoid to rod-shaped with diameters and lengths generally within the ranges given above. The fabric's weave, lack of measurable interstices and compact fiber bundle configuration renders the fabric virtually completely impenetrable to bacteria. High density textile fabrics with excellent water repellent properties with a water repellent surface formed by a number of warps and fillings each having a number of extremely fine, water-repellent fibers having a denier per filament of 1.2 or less are described in published European Patent Application No. 0,124,869, the disclosure of which is hereby incorporated by reference.

The above description applies to a single layer or ply of the fabric; the novel bacterial barrier material of this invention includes a pair of such fabrics with a bacteriostatic polyester/cotton blend layer between them making the entire barrier structure even more impenetrable to bacteria.

The polyester/cotton blend fabric that is optionally treated with a bacteriostatic material is preferably made from a spun yarn containing an intimate blend of 65% polyester fibers and 35% cotton fibers in which the construction is 26/1 warp filling yarns. A preferred source of such a fabric is commercially available from Burlington Industries, Inc. under the trademark CONCEPT®. This particular poly/cotton blend accepts the antimicrobial material well and retains it in the fabric and on the fiber structure.

The antimicrobial compound is a broad spectrum bacteriostatic (or biostatic) material and for convenience is frequently referred to herein as a bacteriostat or bacteriostatic material. The preferred antimicrobial compound applied to the scrub pants, tabard and surgical gown, plus inner layer of the barrier composite is a member of the class of silicone quaternary amines. The preferred silicone quaternary amine antimicrobial material is 3-(trimethoxysilyl)propylocadecyldimethyl ammonium chloride the use of which is described in U.S. Pat. No. 3,730,701, the disclosure of which is hereby incorporated by reference. Suitable antimicrobial silyl quaternary amine compounds have the formula:

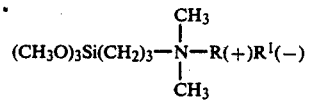

in which R is a $C_{11-22}$ alkyl group and $R^1$ is chlorine or bromine. The preferred silicone quaternary amine is 3-(trimethoxysilyl)propyloctadecyldimethyl ammonium chloride and is available as a 42% active solid in methanol from Dow Corning Corporation of Midland, Mich., under the designation DC-5700. This material is well accepted in commerce and has the necessary U.S. regulatory approvals, not only as a bacteriostatic textile treatment, but also as a bacteriocidal component for medical device/non-drug applications.

The amount of the silicone quaternary amine antimicrobial compound applied to the fabric substrate will be within the following limits: the minimum amount is the quantity needed to achieve a specific minimum level of bacteriostatic activity, or to allow for process variations, if any, to maintain a specific, predetermined level of bacteriostatic activity. The maximum amount will be limited by loss of substantivity as evidenced by crocking during garment construction, excessive wash- or leach-out during laundering or in use, or otherwise, and is balanced by the cost of this relatively expensive component. Best results are obtained when the silicone quaternary amine is present in an amount of from 0.01 to 1.0% by weight, calculated on the weight in the fabric, and preferably in the range of 0.05 to 0.5% by weight similarly calculated.

In addition to the antimicrobial compound, the fabric may be treated with other textile finishes and adjuvants including antistatic agents, water repellents, alcohol and solvent repellents, soil release agents, dyes, tints, optical brighteners, softening agents, sizing resins and the like. The preferred finishes include a soil release agent such as Scotchgard 258 ®, Scotchgard FC-248 ® and Prym 119 ® (acrylic soil release agent) with the antimicrobial agent. The preferred antimicrobial agent, Dow Corning 5700, is cationic and care must be taken in formulating this material with other components, particularly surfactants used to emulsify the polymeric soil release agents. A recommended procedure, in view of this potential incompatibility, is to apply the otherwise incompatible components in separate steps. As an illustration, it is convenient to apply the soil release agent in a first step, such as by padding followed by removing any excess liquid, then applying the antimicrobial compound followed by drying and curing to firmly attach the finish(es) to the substrate. Care in application technique enables one to achieve an uncommonly high degree of washfastness, even fastness to harsh industrial launderings.

The invention will now be further described with reference to the attached Figures.

DETAILED DESCRIPTION OF THE DRAWINGS

The two-component special scrub pants, as illustrated in FIG. 1, are designed to isolate the perineal area of the medical practitioner's body to contain, to the extent possible, potentially worrisome flora. The upper portion 4 is constructed of a bacterial barrier panel, as described in more detail below, and is defined by an elastic or other adjustable waist band 6 and a pair of elastic leg bands 8 positioned at approximately the mid-thigh area which is above the knee joint and is a more comfortable location for the wearer. The bottom portion 10 of the pants are made of a polyester/cotton blend treated with an antimicrobial material and are closed with a pair of stockinette anklets 12. As depicted in FIG. 1, a pocket 14 is provided in the lower portion of the scrub pants.

Figure 2:
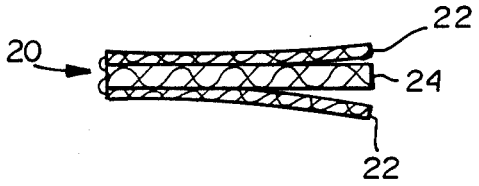
FIG. 2 is an enlarged representation of the three-component barrier panel assembly.

FIG. 2 is a greatly enlarged perspective representation of the barrier panel 20 construction used in the scrub pants described above, and optionally in the tabard and surgical gown as described in more detail below. The barrier panel 20 is fabricated from two outer layers of untreated (that is, no antimicrobial material is applied) thin, tightly woven, fine denier, breathable polyester fabric 22 which provides a comfortable, breathable surface that readily transmits moisture vapor, is highly water resistant and is comfortable for the wearer. An additional, valuable property is that this extremely compact fabric has no or virtually no measurable interstices and is thus highly resistant to bacteria passing through it. The inner layer 24 of the composite is formed from a polyester/cotton blend, either woven or knit, which has been treated with an effective amount of bacteriostatic silyl quaternary amine ammonium compound as described above. It is preferred that the three components of the barrier layer be stitched around the perimeter rather than needle punched or adhesively secured and laminated together to allow for maximum wearer comfort and to maintain breathability of the outer layers. The lower portion of the tunic in FIG. 4 (shown partially separated) also shows the three component barrier layer with the individual layers exposed.

Figure 3:
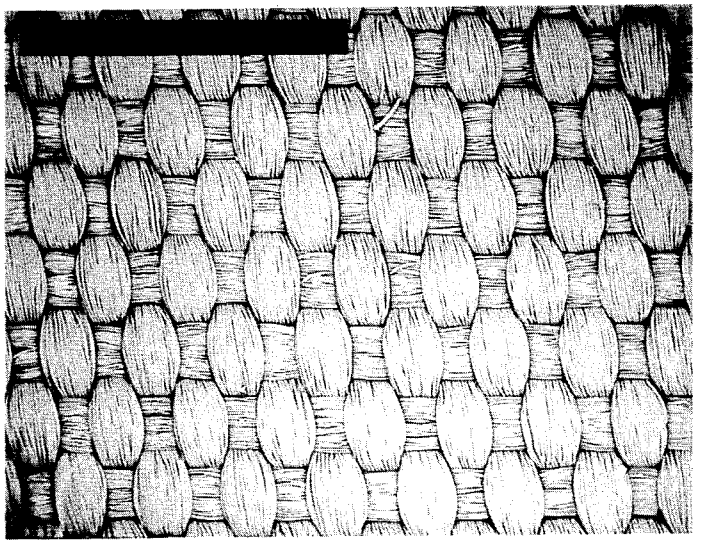
FIG. 3 is a photomicrograph enlarged at a magnification of 50×, showing the tightly woven, fine denier barrier fabric outer layers of the assembly of FIG. 2.

FIG. 3 is a microphotograph taken at 50 power magnification showing the tightly woven yet fine denier polyester used for the outer fabric 22.

FIGS. 4–6 show three different views of the tabard or tunic 30 that may be worn underneath the surgical gown 40, again depending upon the nature of the surgical procedure involved. The tabard includes a front surface 32, a back surface 34 stitched together across the top and open along both sides and secured together with a pair of side ties 36, velcro closures 38 or a waist band 37 that may be tied in the front of the back. Preferably, the front portion of the tabard is made of the barrier panel 20 depicted in FIG. 3, while the back portion may be constructed of a less costly material, for instance the bacteriostatically treated polyester/cotton blend described above. The tabard 30 is used for severe operating conditions where maximum protection against bacterial transmission is required, and worn over the scrub outfit or scrub pant 2, but under the surgical gown 40.

A surgical gown 40 is depicted in FIG. 7, and extends virtually the full length of the medical practitioner. In the version depicted in FIG. 7, barrier panels 20 are provided on both sleeves from the wrist area extending up and beyond the elbow portion of the garment. In addition, the front portion of the garment extending from about the neck line and back to the mid-thigh area is also constructed of the barrier panel material 20 described above. The gown is secured by any convenient method, for instance, as shown in FIG. 4, by a pair of ties. The balance of the gown is constructed from a polyester/cotton bacteriostatically treated material as described above, and is provided with a neck opening and a pair of elastic cuffs composed of the same material as the barrier panel. Preferably, any seams in the barrier will be taped or otherwise treated on the backside (not shown) to prevent moist bacterial strike through.

The barrier panel 20 as depicted in FIGS. 2 and 3 is designed to be light-weight, comfortable to the surgeon, yet effective in preventing bacterial strike through. The panel is a combination or sandwich construction made of a polyester/cotton blend base material 24 that has been treated with an antimicrobial agent and surrounded by a pair of tightly woven, extremely fine denier fabrics 22. The panel 20 is sewn together around the edges and is not glued or laminated in any way. In use, should any bacteria be able to penetrate the very tightly woven outer layer(s) 22, the bacteria will be killed or effectively dealt with the bacteriostatic middle layer. This specific construction provides an effective bacterial barrier layer, where necessary, and the complete gown is designed to be light-weight, comfortable (breathable), and durable.

Other arrangements or means of constructing the garments depicted above will be apparent to those skilled in this art. The drawings and illustrations given above are merely considered exemplary as defining preferred embodiments of the invention.

The efficacy of the tightly-woven, fine-denier, breathable polyester fabric 22 as illustrated in FIG. 2, was compared with a commercially available barrier fabric 100% cotton quarpel treated fabric of approximately 270 total threads per square inch.

Tests were conducted in the manner of J. T. Schwartz et al, "Microbial Penetration of Surgical Gown Materials," Surgery, Gynecology and Obstetrics, 150, 507–512 (1980). In the test, single and double layers of each fabric were used as fabric samples. Each fabric sample was sterilized in an autoclave then placed over a sterile blood agar plate; one surface of the fabric was in contact with the agar and the other formed a pocket. A solution of *Staphyloccus aureus* (ATCC 6538, 17 cfu/ml) was used in the experiment.

The experiment was conducted 3 times under a laminated flux. Each of the fabric samples was placed on a sterile blood culture. Twenty ml of the *Staphyllococcus aureus* bacterial solution at 10 micororganisms/ml was poured over each of the samples and subjected to the times of exposure indicated in the Table. At the same time, three blood cultures were used as a control group. At the end of the exposure time, the fabrics and bacteria were removed and the cultures were incubated at 37° C. for a 24 hour period. Each of the cultures were then observed to determine bacterial growth.

The results of this experiment are given in the following Table:

TABLE 1

| Microbial Penetration Experiment # (Triplicate) | | *S. Aureus* $10^n$/ml #1 | #2 | #3 |
|---|---|---|---|---|
| One Layer | | | | |
| | 30 minutes | + | + | + |
| | 60 minutes | ++ | ++ | ++ |
| | 120 minutes | +++ | +++ | +++ |
| Two Layers | | | | |
| | 30 minutes | – | – | – |
| | 60 minutes | – | – | – |
| | 120 minutes | – | – | – |
| Control Group | | Abundant Growth | | |

This test demonstrates that while one layer of tightly-woven, fine denier polyester fabric 22 did not provide a total barrier, two layers did provide a total barrier. When 2 layers of the tightly-woven, fine denier polyester fabric 22 are separated by the bacteriostatic poly/cotton fabric, two different factors likely combine to provide an enhanced effect. First, the barrier quality of the tightly-woven polyester will likely be enhanced by almost any other fabric used as a "back-up". Secondly, one of the unique ideas about the 3 component barrier panel of this invention is in the fact that the bacteriostatic inner layer serves to retard growth or kill any bacteria migrating through the panel.

An analysis of the data given in the Table reveals the following:

Single-Ply Thickness—The blood cultures exposed to a single-ply fabric which were examined were infected by the permeation of bacteria through the fabric. It is interesting to note that the longer the exposure time, the greater number of bacteria that had permeated the fabric had diminished considerably compared to the concentration of the initial bacterial solution. The number of bacteria blocked by the fabric can be estimated at greater than 60%. This indicates that the fabric serves as a kind of barrier to microorganisms.

Double-ply Thickness—The blood cultures exposed to double-ply thickness of the same fabric showed no bacterial growth, therefor no permeation of the fabric whatsoever. Even after an exposure time of two hours not one microorganism had permeated the fabric.

By contrast, the blood cultures in the control group showed considerable bacterial growth.

It will thus be seen that according to the present invention a garment system has been provided for isolating pathogens from the site of the surgical procedure in an operating room using a combination of fabrics and garments that are comfortable, breathable, moisture-vapor transmissible, light-weight yet effective in preventing pathogen transmission from the medical practitioner to the patient. While the invention has been shown and described as what is presently conceived to be the most practical and preferred embodiment, it will be apparent to those skilled in the art that many modifications may be made within the scope of the invention, which scope is to be accorded the broadest interpretation of the appended claims so as to encompass all equivalent garments, systems and procedures.

What is claimed:

1. A composite barrier material resistant to the transmission of pathogens and composed of an inner layer of fabric having an effective amount of a bacteriostatic compound thereon sandwiched between a pair of water repellent, moisture vapor permeable, breathable fabric outer layers each having an air permeability of less than 15 cubic feet per minute per square foot at 0.5 inches head of water and a moisture vapor transmission of at least 1,000 grams per square meter per 24 hours.

2. The composite barrier material of claim 1, in which the outer layer fabric is a high density woven fabric, woven from a fine denier, multi-filament, synthetic yarn.

3. The composite barrier material of claim 1, in which the synthetic yarn is polyester.

4. The composite barrier material of claim 1, in which inner fabric is a blend of polyester and cotton at least half of which is polyester.

5. The composite barrier material of claim 3, in which the outer fabric has a hydrostatic pressure value of at least 500 mm (AATCC 127-1980).

6. The composite barrier material of claim 5, in which the outer fabric has a hydrostatic pressure value of at least 800 mm (AATCC 127-1980).

7. The composite barrier material of claim 3, in which the outer fabric has a moisture vapor transmission rate of at least 1,400 gm/m$^2$/24hr (ASTM E-96, method A).

8. The composite barrier material of claim 3, in which the outer fabric has a Frazier air porosity value of less than about 3 cubic feet per minute.

9. The composite barrier material of claim 8, in which the outer fabric has a Frazier air porosity value of less than about 2.5 cubic feet per minute.

10. The composite barrier material of claim 4, in which the inner fabric is woven from a spun yarn containing an intimate blend of polyester fibers and cotton fibers.

11. The composite barrier material of claim 1, substantially completely devoid of adhesive between the layers.

12. The composite barrier material of claim 1, in the form of a drapeable panel stitched together at least around its perimeter.

13. The composite barrier material of claim 1, in which the bacteriostatic compound on the inner fabric layer is a silyl quaternary amine compound of the formula:

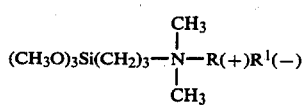

wherein R is an alkyl of 11 to 22 carbon atoms and $R^1$ is a bromine or chlorine.

14. A lower body garment having leg portions and comprising:

a waist portion, a seat portion, a pair of leg portions, expandable leg-conforming means with each leg portion below the waist portion, and stitching connection the waist, seat and leg portions, the garment between the waist portion and the leg-conforming means constructed of water repellent, moisture vapor permeable, breathable fabric, resistant to the transmission of pathogens, having an air permeability of less than 15 cubic feet per minute per square foot at 0.5 inches head of water and a moisture vapor transmission of at least 1,000 grams per square meter per 24 hours, the balance of the garment constructed of an antimicrobial fabric.

15. The lower body garment of claim 14, in which each leg portion has an expandable, ankle-conforming cuff at the bottom thereof.

16. The lower body garment of claim 14, in which each expandable leg-conforming means is in the thigh area of each leg portion.

17. The lower body garment of claim 16, in which the portion between the waist and leg-conforming means is a high density woven fabric, woven from a fine denier, multi-filament, synthetic yarn.

18. The lower body garment of claim 17, in which the synthetic yarn is a polyester.

19. The lower body garment of claim 14, in which the remaining fabric is a blend of polyester and cotton at least half of which is polyester.

20. The lower body garment of claim 19, in which the fabric is a woven fabric woven from a spun yarn containing an intimate blend of polyester fibers and cotton fibers.

21. The lower body garment of claim 19, in which the bacteriostatic compound on the polyester and cotton blend fabric is a silyl quaternary amine compound of the formula:

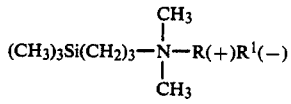

wherein R is an alkyl of 11 to 22 carbon atoms and $R^1$ is a bromine of chlorine.

22. A surgical tabard for use under a surgical gown, the tabard having a neck opening, two arm openings, bacteriostatic, antimicrobial back portion and a front portion constructed of a water repellent, moisture vapor permeable, breathable fabric, resistant to the transmission of pathogens layers each having an air permeability of less than 15 cubic feet per minute per square foot at 0.5 inches head of water and a moisture vapor transmission of at least 1,000 grams per square meter per 24 hours.

23. The surgical tabard of claim 22, in which the front layer fabric is a high density woven fabric, woven from a fine denier, multi-filament, synthetic yarn.

24. The surgical tabard of claim 22, in which the fabric used to compose the garment's reverse (back panel) is woven from a spun yarn containing an intimate blend of polyester fibers and cotton fibers.

25. The surgical tabard of claim 22, in which the bacteriostatic compound on the fabric of the back portion is a silyl quaternary amine compound of the formula:

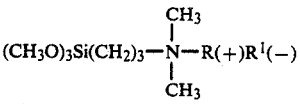

wherein R is an alkyl of 11 to 22 carbon atoms and $R^1$ is a bromine or chlorine.

26. A surgical gown having a neck opening, a pair of sleeves, an expandable cuff at the end of each sleeve, and a portion stitched to a back portion to form the body of the surgical gown, in which at least half of the front portion from the neck downward is constructed of a composite barrier material resistant to the transmission of pathogens and composed of an inner layer of fabric having an effective amount of a bacteriostatic compound thereon sandwiched between a pair of water repellent, moisture vapor permeable, breathable outer fabric layers each having an air permeability of less than 15 cubic feet per minute per square foot at 0.5 inches head of water and a moisture vapor transmission of at least 1,000 grams per square meter per 24 hours, the remaining portions of the gown constructed from a biostatic or bacteriostatic fabric.

27. The surgical gown of claim 26, in which the sleeves and cuffs are constructed of the same composite barrier material as the front portion.

28. The surgical gown of claim 26, in which the composite barrier material extends from the neck opening downward to at least two-thirds of the front portion.

29. The surgical gown of claim 26, in which the outer layer fabric is a high density woven fabric, woven from a fine denier, multi-filament, synthetic yarn.

30. The surgical gown of claim 26, in which the composite barrier material on the front portion of the gown is stitched together at least around its perimeter.

31. The surgical gown of claim 29, in which the bacteriostatic compound on the inner fabric layer of the composite barrier material is a silyl quaternary amine compound of the formula:

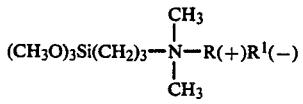

wherein R is an alkyl of 11 to 22 carbon atoms and $R^1$ is a bromine or chlorine.

32. The surgical gown of claim 29, in which the inner fabric of the composite barrier material is a fabric woven from a spun yarn containing an intimate blend of polyester fibers and cotton fibers.

33. The surgical gown of claim 32, in which the bioactive compound on the inner fabric layer and the bacteriostatic fabric from which the balance of the gown is constructed is a silyl quaternary amine compound of the formula:

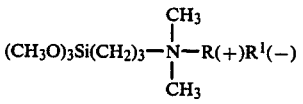

wherein R is an alkyl of 11 to 22 carbon atoms and $R^1$ is a bromine or chlorine.

34. In combination, a surgical operating garment system including:

a lower body garment having leg portions comprising a waist portion, a seat portion, a pair of leg portions, expandable leg-conforming means with each leg portion below the waist portion, and stitching connecting the waist, seat and leg portions, the garment between the waist portion and the leg-conforming means constructed of a water repellent moisture vapor permeable, breathable fabric resistant to the transmission of pathogens, each having an air permeability of less than 15 cubic feet per minute per square foot at 0.5 inches head of water and a moisture vapor transmission of at least 1,000 grams per square meter per 24 hours and the balance of the garment constructed of a bacteriostatic, antimicrobial fabric, and a surgical gown having a neck opening, a pair of sleeves, an expandable cuff at the end of each sleeve, and a front portion stitched to a back portion to form the body of the surgical gown, in which at least half of the front portion from the neck downward is constructed of said composite barrier material, the remaining portions of the gown constructed from a fabric having a bacteriostatic compound thereon.

35. The surgical operating garment system of claim 34, in which the outer layer fabric of the barrier material is a high density woven fabric, woven from a fine denier, multi-filament, synthetic yarn.

36. The surgical operating garment system of claim 35, in which the inner fabric is a woven fabric woven from a spun yarn containing an intimate blend of polyester fibers and cotton fibers.

37. In combination, a surgical operating garment system including:

a lower body garment having leg portions comprising a waist portion, a seat portion, a pair of leg portions, an expandable leg-conforming means with each leg portion below the waist portion, and stitching connecting the waist, seat and leg portions, the garment between the waist portion and the leg-conforming means constructed of a water repellent, moisture vapor permeable, breathable fabric, resistant to the transmission of pathogens, having an air permeability of less than 15 cubic feet per minute per square foot at 0.5 inches head of water and a moisture vapor transmission of at least 1,000 grams per square meter per 24 hours, the balance of the lower body garment constructed of a bacteriostatic antimicrobial fabric, a surgical tabard for use under a surgical gown, the tabard having a neck opening, two arm openings, a front portion constructed of said water repellent, moisture vapor permeable, breathable fabric, and a surgical gown having a neck opening, a pair of sleeves, an expandable cuff at the end of each sleeve, and a front portion stitched to a back portion to form the body of the surgical gown, in which at least half of the front portion from the neck downward is constructed of the composite barrier material, the remaining portions of the gown constructed from a fabric having a bacteriostatic compound thereon.

38. The surgical operating garment system of claim 37, in which the outer layer fabric of the barrier material is a high density woven fabric, woven from a fine denier, multi-filament, synthetic yarn.

39. The surgical operating garment system of claim 37, in which the inner fabric is a fabric woven from a spun yarn containing an intimate blend of polyester fibers and cotton fibers.

* * * * *